United States Patent [19]

Henley, Sr.

[11] Patent Number: 4,655,003

[45] Date of Patent: Apr. 7, 1987

[54] SHUTTER ASSEMBLY WITH INDIVIDUALLY REMOVABLE SLATS

[76] Inventor: John B. Henley, Sr., 27128 Nona Ave., Highland, Calif. 92346

[21] Appl. No.: 852,839

[22] Filed: Apr. 16, 1986

[51] Int. Cl.[4] ..... E05F 17/00; E06B 7/08

[52] U.S. Cl. ..... 49/88; 49/74

[58] Field of Search ..... 49/88, 87, 74–81, 49/86, 89, 90, 91

[56] References Cited

U.S. PATENT DOCUMENTS

| | | | |
|---|---|---|---|
| 165,812 | 7/1875 | Fletcher | 26/62 |
| 363,984 | 5/1887 | Brown | 49/87 |
| 472,592 | 4/1892 | Swartz | 26/62 |
| 1,404,161 | 1/1922 | Page | 26/62 |
| 1,582,111 | 4/1926 | Wogan | 26/62 |
| 2,742,681 | 4/1956 | Goodwyn | 26/62 |
| 3,284,951 | 11/1966 | Shapiro | 49/75 |
| 3,451,165 | 6/1969 | O'Hair | 49/87 |
| 3,691,687 | 9/1972 | Economou | 49/74 |

*Primary Examiner*—Kenneth Downey
*Attorney, Agent, or Firm*—Klein & Szekeres

[57] ABSTRACT

A shutter or blind assembly comprises a plurality of verically-spaced, horizontally-extending slats rotatably mounted between a pair of opposed vertical side rails. Each of the side rails has a plurality of vertically-spaced, horizontal grooves extending rearwardly from the forward edge thereof, and each of the grooves has a downwardly-extending notch formed contiguously therewith. Each slat has a dowel at each end, and the dowels on each slat are removably received in an opposed pair of grooves so as to be rotatably seated in an opposed pair of notches. A vertical tilt bar interconnects most or all of the slats. The tilt bar comprises an inner member which is removably retained in an outer member. The inner member removably receives a vertically-spaced plurality of hooks or eyelets that are attached to the slats. Each slat is individually removable from the assembly by separating the inner and outer tilt bar members, allowing the hooks or eyelets to be removed from the inner member. The selected slat is then removed from the side rails by lifting the dowels out of the notches and sliding the slat forwardly out of the grooves. The tilt bar is re-attached by re-seating the hooks or eyelets in the inner member and then re-inserting the inner member into the outer member to lock the hooks or eyelets in place.

24 Claims, 7 Drawing Figures

FIG. 1
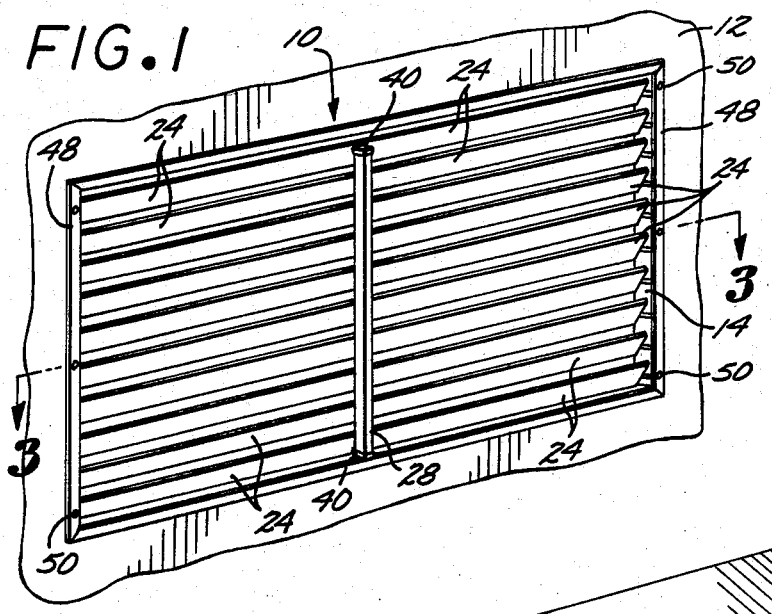
FIG. 2
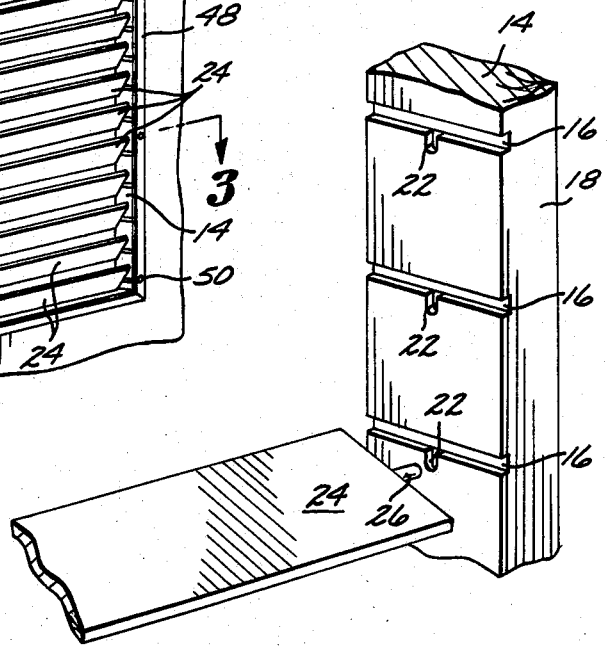
FIG. 5
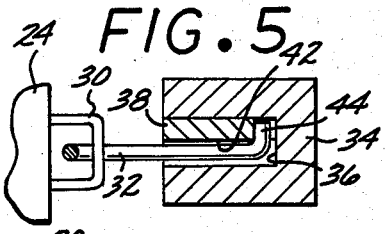
FIG. 3
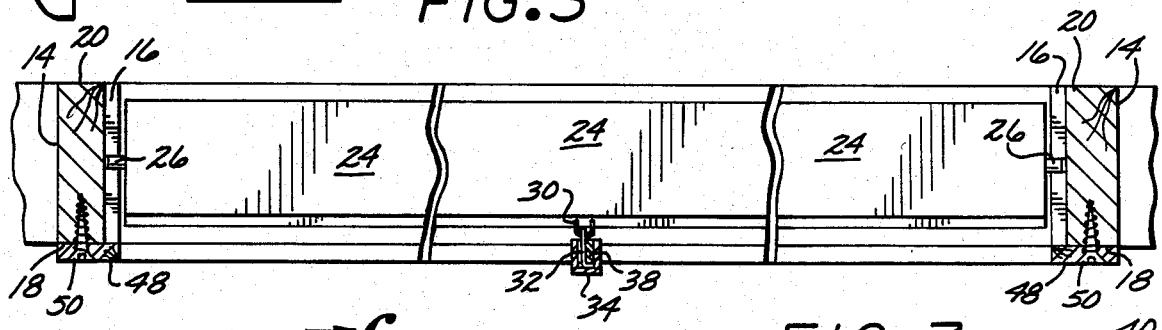
FIG. 4
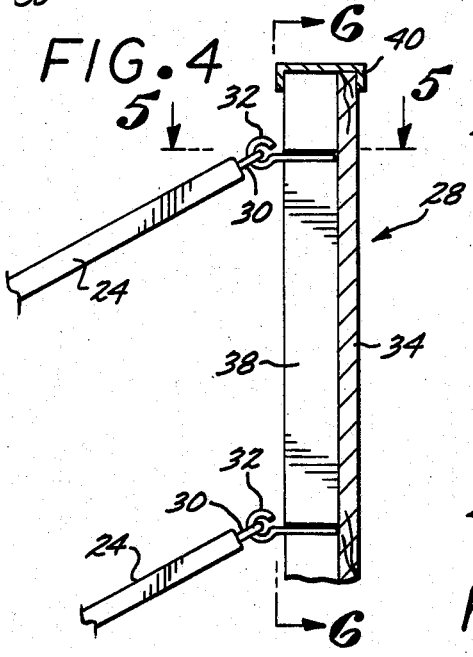
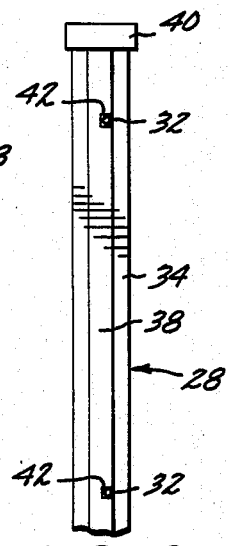
FIG. 6
FIG. 7
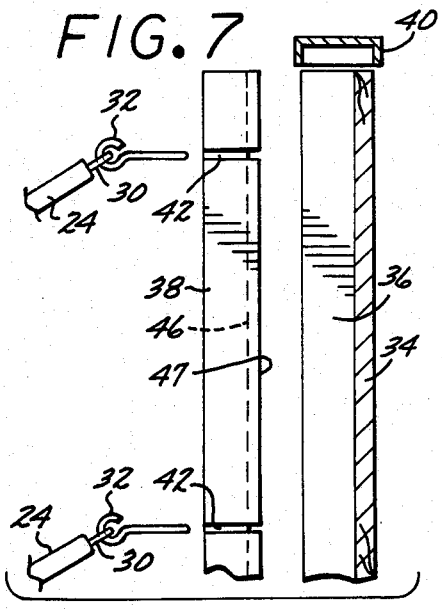

SHUTTER ASSEMBLY WITH INDIVIDUALLY REMOVABLE SLATS

BACKGROUND OF THE INVENTION

The present invention relates generally to the field of shutters and blinds for windows and doorways. More particularly, the present invention relates to a shutter or blind assembly that can be permanently installed in a window or doorway, and yet allows the removal of individual slats for cleaning, repair, and replacement.

Shutters and blinds, of the general type having a plurality of vertically-spaced, horizontal slats that are rotatably adjustable, are well known in the art. See, for example, U.S. Pat. Nos. 165,812; 1,582,111; 2,742,681; and 3,691,687. Typically, such shutter and blind assemblies comprise a pair of spaced apart, vertical side rails or stiles, and a plurality of horizontal slats rotatably mounted in the side rails so that the slats can be adjusted between a closed position (in which the slats vertically overlap), and an open position (in which the slats are vertically spaced apart). The slats frequently have their forward edges attached to a vertically-oriented tilt bar, which keeps the slats uniformly oriented, and which allows them to be adjusted in unison.

A significant disadvantage of prior art shutter and blind assemblies is that they lack any mechanism for conveniently removing and replacing individual slats once the assemblies are installed in a window or doorway. Therefore, the removal of the slats for cleaning is impractical, while the replacement of individual slats that have become damaged, if at all possible, is difficult and time-consuming.

The aforementioned U.S. Pat. No. 1,582,111 to Wogan discloses an adjustable blind assembly in which the slats are individually removable. The disclosed mechanism is, however, relatively complex and inconvenient to use. Also, this mechanism produces a visually cluttered appearance that is inconsistent with the clean lines dictated by modern aesthetics. Furthermore, there is no provision in the Wogan apparatus for a tilt bar. If a tilt bar were to be provided on the Wogan device, it would have to be detachable from the slats to allow the slats to be individually removable from the assembly. There is no suggestion of such a feature, however, in the prior art.

Thus, there is a long-felt, but as yet unsatisfied, need for a shutter or blind assembly that includes a tilt bar for adjusting the slats in unison, and which allows each of the slats to be separately and individually removed and replaced while the shutter or blind assembly is installed in a window or doorway. Such a shutter or blind assembly should, in addition, have a clean, uncluttered appearance for decorative purposes. Both of these functions would be best served by a mechanism that is relatively simple to construct, and easy for a person without a great deal of mechanical skill to assemble and disassemble.

SUMMARY OF THE INVENTION

Broadly, the present invention is a shutter or blind assembly, of the type including a plurality of horizontal slats rotatably mounted between a pair of opposed vertical side rails, and a tilt bar interconnecting at least some of the slats for rotating them in unison, wherein each of the interconnected slats is individually removable from both the side rails and from the tilt bar.

More specifically, in the shutter or blind assembly of the present invention, the slats are provided with a dowel at each end. The side rails are each provided with a plurality of vertically-spaced sockets which rotatably receive the dowels of the slats. Each of the sockets is formed as a notch extending downwardly from a horizontal groove extending rearwardly from the forward edge of the side rail. Preferably, the notch is formed approximately mid-way between the forward and rearward edges of the side rail, with the groove extending rearwardly beyond the notch. This construction allows the dowels on each slat to be removably received in an opposed pair of grooves so as to be rotatably seated in an opposed pair of notches. Thus, the grooves provide a path for the dowels through the side rails to allow the dowels to be inserted into, and removed from, the notches, thereby allowing each slat to be individually installed in, and removed from, the side rails.

To allow the slats to be removable from the tilt bar, a novel attachment mechanism is employed. Specifically, each of the slats has a loop extending from its forward edge, the loop being advantageously provided by a large staple. The tilt bar comprises a first elongate vertical member having a longitudinal channel, and a second elongate vertical member removably retained in the channel. The second, or inner vertical member has a plurality of vertically-spaced, transverse slots, each of which removably receives a loop-engaging member, such as an eyelet. When the second, or inner vertical member is retained in the channel of the first, or outer, vertical member, the loop-engaging members are retained in the slots, while the removal of the inner vertical member from the channel allows each of the loop-engaging members to be individually removed from its associated slot.

The novel construction of the present invention offers a number of advantages. Of key importance is the facility of installing and removing individual slats, without removing the whole assembly, by simply disconnecting the tilt bar and removing from it the loop-engaging member connected to the slat to be removed, and then sliding the dowels of the selected slat forwardly out of the grooves associated with that slat's sockets. In this manner, one or more slats can be quickly and easily replaced for repair, cleaning, painting, etc. Also, the easy removal of the tilt bar from the slats facilitates their cleaning by removing the obstruction presented by the tilt bar. Furthermore, these advantages are achieved with a construction that does not detract from the aesthetic qualities of the shutters or blinds.

These and other advantages of the present invention will be better understood from the detailed description which follows.

BRIEF DESCRIPTION OF THE DRAWINGS

FIG. 1 is a perspective view of a window blind assembly constructed in accordance with the present invention;

FIG. 2 is a detailed perspective view of a portion of the blind assembly of FIG. 1, showing the arrangement of notched grooves in one of the side rails;

FIG. 3 is a cross-sectional view taken along line 3—3 of FIG. 1;

FIG. 4 is a cross-sectional view taken longitudinally through the tilt bar of the present invention, showing the tilt bar connected to the slats;

FIG. 5 is a cross-sectional view taken along line 5—5 of FIG. 4;

FIG. 6 is a rear elevational view of the tilt bar shown in FIG. 4, taken along line 6—6 of FIG. 4; and FIG. 7 is a view similar to FIG. 4, but showing the tilt bar removed from the slats.

DETAILED DESCRIPTION OF THE INVENTION

Referring first to FIG. 1, a shutter assembly 10, in accordance with a preferred embodiment of the invention, is shown installed in a window frame 12. In the context of this specification, the terms "shutter" and "blind" are to be used interchangeably, some people preferring the term "blind" for an assembly that includes adjustable slats, as the present invention does. Although the description which follows discloses the invention as installed in a window frame, it should be understood that the shutter assembly 10, with minor modifications (such as a hinge attachment on one side) can be installed in a doorway.

The shutter assembly 10 includes a pair of opposed vertical side rails 14, as shown in more detail in FIGS. 2 and 3. Each side rail 14, as best shown in FIG. 2, has a plurality of vertically-spaced horizontal grooves 16 extending rearwardly from the forward edge 18 of the side rail 14. In the preferred embodiment shown, the grooves 16 extend all the way to the rearward edge 20 of the side rail 14, but they may terminate somewhere between the longitudinal middle of the side rail and the rearward edge thereof.

Each of the grooves 16 is provided with a downwardly-depending notch 22 which is contiguous with the rest of the groove 16. Preferably, the notches 22 are longitudinally aligned about mid-way between the forward edge 18 and the rearward edge 20 of the side rail. The grooves and notches in one side rail are, of course, horizontally aligned with those in the other rail to form a plurality of opposed pairs of grooves and notches.

The shutter assembly 10 also includes a plurality of elongate, horizontally-extending slats 24, each having a rounded projection or dowel 26 extending from each end thereof. As shown in FIGS. 2 and 3, each of the dowels 26 is slidably received in a groove 16 so as to be seated in the notch 22 of that groove. Thus, the dowels 26 on each slat 24 are removably received in an opposed pair of grooves 16 and removably seated in an opposed pair of notches 22, the latter providing sockets in which the dowels 26 may rotate.

With the slats 24 thus mounted between the side rails 14, they are free to be rotated as a result of the rotatable fitting between the dowels 26 and the notches 22. By rotating the slats 24, they can be adjusted, as is well-known with prior art shutter and blind assemblies, between an open position, in which adjacent slats are vertically spaced apart, and a closed position, in which adjacent slats are vertically overlapping. As in prior art shutter and blind assemblies, it is desirable to interconnect most, if not all, of the slats by some closure means so that they can be adjusted in unison. Accordingly, a tilt bar 28 is employed to this end. As in prior art assemblies, the tilt bar 28 of the present invention is pivotably attached to some or all of the slats 24 by means of a loop-forming member, such as a staple 30, attached to the forward edge of each of the interconnected slats, as shown in FIGS. 3, 4, and 5. The staples 30, in turn, are engaged by a plurality of vertically-spaced engagement members, such as hooks or eyelets 32, attached to the tilt bar 28.

Unlike prior art shutter and blind assemblies, however, the present invention employs a novel tilt bar construction that facilitates the removal and replacement of individual slats separately from the other slats. This construction is best shown in FIGS. 4 through 7.

Specifically, the tilt bar 28 comprises a first, or outer, elongate vertical member 34 having a longitudinal channel 36. Removably seated in the channel 36 is a second, or inner, elongate vertical member 38, which is retained in placed by removable retainer caps 40 at the top and bottom ends of the tilt bar 28. One side of the inner vertical member 38 is provided with a plurality of vertically-spaced transverse slots 42, each of which removably receives the shank portion of one of the eyelets 32. To keep the eyelets 32 positionally-fixed in the slots 42 when the inner vertical member 38 is seated in the channel 36, each of the eyelet shanks has a bent end 44 that engages the inner edge of the inner vertical member 38. To provide space between the inner vertical member 38 and the outer vertical member 34 to accommodate the bent shank ends 44, the slotted side of the inner vertical member 38 is wider than the unslotted side (as shown by the dashed line 46 in FIG. 7), thereby forming a longitudinal extension or "stand-off" 47 that provides the required clearance. It can be appreciated that with the inner vertical member 38 seated in the channel 36 and retained therein by the end caps 40, the eyelets 32 will be retained in the slots 42.

When it is desired to remove a slat 24 for repair or cleaning, the tilt bar 28 is first removed, as shown in FIG. 7, by removing the end caps 40 and then removing the inner vertical member 38 from the channel 36 in the outer vertical member 34. The separation of the two vertical members allows the eyelet shanks to be removed from the slots 42, the eyelets 32 remaining attached to the staples 30 in the slats. With the tilt bar 28 removed, the selected slat 24 can be removed from the assembly by lifting it up out of the sockets provided by the notches 22, and then sliding the slat forward out of the grooves 16. It may be easier to remove the slat in some instances by moving one end forwardly before sliding the other end out. To facilitate this side-to-side motion, the grooves 16 are preferably extended rearwardly of the notches 22, as previously mentioned. When the selected slat is removed, the shanks of the eyelets 32 attached to the remaining slats are re-seated in the slots 42, and the inner vertical member 38 is reinstalled into the channel 36 and retained therein by the end caps 40 to lock the eyelet into place, as previously described. If desired, before the tilt bar 28 is re-attached to the slats 24, a new slat may be installed in place of the removed slat by seating its dowels 26 in the notches 22 by means of the grooves 16, in the aforementioned manner.

As best shown in FIGS. 1 and 3, the assembly in accordance with the present invention may optionally be provided with a retention strip 48 removably attached (as by wood screws 50) along the forward edge 18 of each of the side rails 14. The retention strips 48 form a termination for each of the grooves 16 which blocks the removal of the dowels 26 therefrom. In addition, the retention strips 48 may improve the aesthetic qualities of the assembly by providing a framed outline that is unbroken by the ends of the grooves 16. The use of means such as the wood screws 50 to attach the retention strips 48 facilitates their easy removal when it is desired to remove a slat.

There has thus been described a shutter or blind assembly that allows each of the slats to be separately and individually removed from the side rails, and which also includes a tilt bar from which the slats can be individually removed. This function is provided with a structure that is economical to manufacture and simple to install and use, and yet which provides the clean, uncluttered look demanded by aesthetic considerations.

While a preferred embodiment of the invention has been described, it will be appreciated that a number of modifications may suggest themselves to those skilled in the pertinent arts. For example, the configuration of the grooves 16 and their associated notches 22 in the side rails 14 may be altered to suit varying needs. Moreover, the grooves and notches can be provided in both sides of a single side rail, which could then be used as a side rail for two adjacent blind or shutter assemblies. Finally, it should be noted that the construction of the tilt bar described herein is exemplary only of the best mode of practicing the invention currently contemplated by the inventor, and it is expected that other mechanisms for removably attaching the tilt bar to the slats will be devised by those skilled in the pertinent arts. Therefore, these and other modifications which may suggest themselves should be considered within the spirit and scope of the present invention, as defined in the claims which follow.

What is claimed is:

1. A shutter assembly, comprising:

a pair of opposed vertical side rails, each having a plurality of vertically-spaced, horizontally-extending grooves, each of said grooves having a downwardly-extending notch; and a plurality of horizontal slats, each having first and second opposed ends with a dowel extending from each of said ends;

whereby the dowels on each of said slats are removably received in an opposed pair of said grooves so as to be rotatably seated in an opposed pair of said notches.

2. The shutter assembly of claim 1, further comprising closure means, interconnecting at least some of said slats, for simultaneously rotating said interconnected slats between an open position in which adjacent slats are vertically spaced apart and a closed position in which adjacent slats are vertically overlapping.

3. The shutter assembly of claim 1, wherein each of said side rails has a forward edge and each of said grooves extends to said forward edge.

4. The shutter assembly of claim 3, further comprising a removable retention strip vertically disposed along the forward edge of each of said side rails and forming a termination for each of said grooves.

5. The shutter assembly of claim 2, wherein said closure means comprises:

a vertically disposed tilt bar; and attachment means for pivotably attaching said tilt bar to each of said interconnected slats.

6. The shutter assembly of claim 5, wherein each of said slats is individually attachable to, and removable from, said tilt bar by said attachment means.

7. The shutter assembly of claim 6, wherein said attachment means comprises:

a loop-forming member on each of said interconnected slats; and a plurality of vertically-spaced engagement members on said tilt bar, each of said engagement members being individually attachable to, and separable from, said tilt bar, each of said engagement members being engageable with one of said loop-forming members.

8. The shutter assembly of claim 7, wherein said tilt bar comprises:

a first elongate vertical member having a longitudinal channel; and a second elongate vertical member removably retained in said channel, said second vertical member having a plurality of vertically-spaced, transverse slots, each of which removably receives one of said engagement members;

whereby the retention of said second vertical member in said channel retains said engagement members in said slots, and the removal of said second vertical member from said channel allows each of said engagement members to be removed from its associated slot.

9. A shutter assembly, comprising:

a pair of opposed vertical side rails;

a plurality of horizontal slats rotatably mounted between said side rails, each of said slats being individually removable from said side rails; and a tilt bar interconnecting at least some of said slats so as to rotate said interconnected slats in unison, each of said slats being attachable to, and removable from, said tilt bar.

10. The shutter assembly of claim 9, wherein each of said slats includes a dowel at each end thereof, and wherein each of said side rails includes means defining a plurality of vertically-spaced sockets, each of said sockets being oriented and dimensioned to removably receive one of said dowels.

11. The shutter assembly of claim 10, wherein said socket-defining means comprises:

a plurality of vertically-spaced, horizontally-extending grooves; and a downwardly-extending notch in each of said grooves;

whereby the dowels on each of said slats are removably received in an opposed pair of said grooves so as to be rotatably seated in an opposed pair of said notches.

12. The shutter assembly of claim 11, wherein each of said side rails has a forward edge, wherein each of said grooves extends to said forward edge, and wherein said shutter assembly further comprises a retention strip removably attached along said forward edge of each of said side rails and forming a termination for each of said grooves.

13. The shutter assembly of claim 9, wherein each of said interconnected slats includes a loop-forming member on one edge thereof, and wherein said tilt bar includes a plurality of vertically-spaced engagement members, each of said engagement members being individually attachable to, and separable from, said tilt bar, each of said engagement members being engageable with one of said loop-forming members.

14. The shutter assembly of claim 13, wherein said tilt bar comprises:

a first elongate vertical member having a longitudinal channel; and a second elongate vertical member removably retained in said channel, said second vertical member having a plurality of vertically-spaced, transverse slots, each of which removably receives one of said engagement members;

whereby the retention of said second vertical member in said channel retains said engagement members in said slots, and the removal of said second vertical member from said channel allows each of said engagement members to be removed from its associated slot.

15. A shutter assembly, of the type including a plurality of horizontal slats rotatably mounted between a pair of opposed vertical side rails, and a tilt bar interconnecting at least some of said slats for rotating said interconnected slats in unison, characterized in that each of said interconnected slats is individually removable from said side rails and from said tilt bar.

16. The shutter assembly of claim 15, wherein each of said slats includes a dowl on each end thereof, and wherein each of said side rails includes means defining a plurality of vertically-spaced sockets, each of which is oriented and dimensioned to removably receive one of said dowels.

17. The shutter assembly of claim 16, wherein said socket-defining means comprises:

a plurality of vertically-spaced, horizontally-extending grooves; and a downwardly-extending notch in each of said grooves;

whereby the dowels on each of said slats are removably received in an opposed pair of said grooves so as to be rotatably seated in an opposed pair of said notches.

18. The shutter assembly of claim 17, wherein each of said side rails has a forward edge to which each of said grooves extends, said shutter assembly further comprising retention means, removably attached to the forward edge of each of said side rails, for blocking the ends of said grooves to prevent the removal of said dowels therefrom.

19. The shutter assembly of claim 15, wherein each of said interconnected slats includes a loop-forming member on one edge thereof, and wherein said tilt bar includes a plurality of vertically-spaced engagement members, each of said engagement members being individually attachable to, and separable from, said tilt bar, each of said engagement members being engageable with one of said loop-forming members.

20. The shutter assembly of claim 19, wherein said tilt bar comprises:

a first elongate vertical member having a longitudinal channel; and a second elongate vertical member removably retained in said channel, said second vertical member having a plurality of vertically-spaced, transverse slots, each of which removably receives one of said engagement members;

whereby the retention of said second vertical member in said channel retains said engagement members in said slots, and the removal of said second vertical member from said channel allows each of said engagement members to be removed from its associated slot.

21. A shutter assembly, comprising:

a first vertical side rail having a first plurality of vertically-spaced sockets;

a second vertical side rail spaced from said first side rail and having a second plurality of vertically-spaced sockets horizontally aligned with, and opposed to, said first plurality of sockets;

a plurality of elongate horizontal slats, each with first and second opposed ends, each of said ends having a projection, the projection on each of said slats being rotatably seated in an opposed pair of said sockets;

a groove extending horizontally from each of said sockets to a forward edge of the side rail in which said sockets are located;

a tilt bar interconnecting at least some of said slats for rotating said slats in unison; and attachment means for removably attaching said tilt bar to each of said interconnected slats;

whereby each of said slats is individually removable from said side rails and from said tilt bar without the removal of any other slat.

22. The shutter assembly of claim 21, wherein each of said sockets comprises a notch extending downwardly from one of said grooves.

23. The shutter assembly of claim 21, wherein each of said interconnected slats includes a loop-forming member on one edge thereof, and wherein said tilt bar includes a plurality of vertically-spaced engagement members, each of which is individually attachable to, and separable from, said tilt bar, and each of which is engageable with one of said loop-forming members.

24. The shutter assembly of claim 23, wherein said tilt bar comprises:

a first elongate vertical member having a longitudinal channel; and a second elongate vertical member removably retained in said channel, said second vertical member having a plurality of vertically-spaced, transverse slots, each of which removably receives one of said engagement members;

whereby the retention of said second vertical member in said channel retains said engagement members in said slots, and the removal of said second vertical member from said channel allows each of said engagement members to be removed from its associated slot.

* * * * *